US005167549A

United States Patent [19]

Glen

[11] Patent Number: 5,167,549

[45] Date of Patent: Dec. 1, 1992

[54] MOUNTING AND CONTROL OF OUTBOARD MOTORS

[75] Inventor: Robert D. Glen, Oxford, England

[73] Assignee: E. P. Barrus, England

[21] Appl. No.: 811,886

[22] Filed: Dec. 19, 1991

Related U.S. Application Data

[63] Continuation of Ser. No. 493,155, Mar. 14, 1990, abandoned.

[30] Foreign Application Priority Data

Mar. 16, 1989 [GB] United Kingdom ..... 8906063

[51] Int. Cl.[5] ..... B63H 21/26

[52] U.S. Cl. ..... 440/84; 440/900

[58] Field of Search ..... 114/144 R, 160, 146; 440/63, 87, 900, 53, 84; 74/480 R, 480 B, 481, 482, 484 R, 491, 492, 494

[56] References Cited

U.S. PATENT DOCUMENTS 2,237,834 4/1941 Landgraf, Jr. ..... 114/144 R
3,206,998 9/1965 Matz, Jr. et al ..... 114/144 R
3,918,311 11/1975 Maier ..... 74/37
3,922,996 12/1975 Meyer ..... 440/87

FOREIGN PATENT DOCUMENTS 0255346 2/1988 European Pat. Off. .
1400753 7/1975 United Kingdom .
2031362 4/1980 United Kingdom .

*Primary Examiner*—Edwin L. Swinehart
*Attorney, Agent, or Firm*—Andrus, Sceales, Starke & Sawall

[57] ABSTRACT

A replacement single tiller (1) has a cubical hollow base (4) from which throttle-operating cables (8a 8b) (etc) extend to different motor throttles for simultaneous throttle control. Within base (4) is rotary shaft (33) mounting pinions (30, 31) about the peripheries of which cables (8a 8b) are respectively moved by push-pull entrainment. Twist grip (3) on shaft (33) therefore controls both motors. Projection (5) fits between parallel arms of a motor bracket and is held therein by pin (18) in bore (14); such brackets are mutually interconnected by a transverse conducting rod for joint steering by the tiller.

7 Claims, 5 Drawing Sheets

MOUNTING AND CONTROL OF OUTBOARD MOTORS

This is a continuation of application Ser. No. 07/493,155, filed Mar. 14, 1990, now abandoned.

THIS INVENTION relates to outboard motors for light marine craft, and in particular to the placement, steering, and control of two or more such motors arranged for joint driving action at the stern of such a light vessel.

It is of course well known to provide an outboard motor as a fitment at an end of a light marine craft. Typically this motor is bolted or clamped to the transom and provides motive power to a submerged propeller from an internal combustion engine at its upper part. Steering is effected by swinging the whole motor round a vertical pivoting axis using a forwardly-projecting steering tiller, and power to the motor, is typically controlled by a twist grip upon this steering tiller connected to a conventional throttle.

It is also well known to mount two or more such motors side by side at the rear of the craft, to provide increased power. The invention is particularly concerned with such arrangements. For convenience of description it will refer to a twin motor arrangement, it being understood however that similar arrangements for a triple motor mounting also fall within the scope of the invention as defined below.

When two motors are mounted side by side at the stern of a vessel, some provisions must be made for convenient control of steering and power of motors. One known arrangement provides a detachable bar to connect the two tillers, so that movement of one tiller automatically involves movement of the other tiller. Typically, with such an arrangement a separate throttle control is envisaged.

Another known arrangement, as described in our earlier G.B. Patent 2031362 is to provide an additional single tiller. Such a tiller is connected to one of the motors, and protrude forwardly essentially along the longitudinal median line of the vessel. The two motors are themselves interconnected by a tie rod, adjustable in length, between two motor mounting brackets. Push pull throttle cables extend from the additional tiller to each motor, and a joint gear change unit with connecting cables is attached to one side of the additional tiller. In use, the individual tiller arms are folded up out of the way, the single additional tiller arm is used to control both ends steering and power.

Such an arrangement, while convenient for larger engines and readily useable in that only one tiller protrudes forward from the motors, is somewhat elaborate and expensive. Accordingly, it has recently been proposed by the present Applicants to utilise a further type of interconnection, comprising two parts. One part is a rod interconnecting the steering brackets of the two motors, so that as one motor turns for steering the other motor turns with it. The other part is a rod connected to the twist portion of the relative throttle grips, so that as one twist portion turns to control the throttle the other twist portion also turns.

In this arrangement, instead of a single tiller there still remains both existing tillers, but either can be used to control both engines.

In a study of such twin motor systems, we have realised that joint control arrangements can vary in accordance with the size, cost, and intended use of the craft, moreover their effectiveness is also linked to the accuracy of alignment of the two motors at the stern of the vessel, and to the accessibility of other controls such as gear levers. The present invention, while being generally concerned with the production, control, and use of a twin or like motor system for marine craft, is particularly concerned with such areas of improvement.

This invention sets out to provide a readily attachable heavy duty single tiller, of modified internal construction.

In one aspect the invention provides a tiller for a joint control system for two or more outboard motors, of the type in which a single additional tiller with twist grip is used to control both pivoting and throttle of the mechanically interconnected outboard motors: characterised in that the said single tiller possesses connected to its twist grip a longitudinal shaft rotary around its axis and carrying one or two pinions interacting with the configured inner ends of throttle-operating cables, one to each pinion, so as to entrain the cable peripherally for movement in either direction, whereby twisting of the grip on the tiller and consequent rotation of the longitudinal shaft rotates the worm gear to cause the throttle cables, attached thereto and passing one to each motor, to control the throttles of each said motor simultaneously and to like extents.

Usually there will be two such cables, for attachment to two motors, although three of more can be utilised.

Preferably, the throttle cables will each be provided with easy-attachment terminations for a conventional throttle control in the motor.

The operation of the invention depends upon the configured cable surface (e.g. a wound or twisted wire) being entrained around a suitable pinion. Preferably the inner cable end is not crumpled or looped in case its configuration is changed and it slips on the pinion Preferably, therefore, there are provided projecting cable end housings extending e.g. along lines tangential to the pinion perpheries.

Typically, the tiller will be adapted for easy assembly to a motor bracket, by configuration comprising (a) a projection at the base of the tiller, having a through transverse bore (b) parallel spaced arms on the motor bracket have actually aligned through bores, to receive the projection in the space with all bores aligned and (c) a movable pin capable of being received within the aligned bores to connect the tiller and the bracket. Preferably, the pin will have an end latch capable of adapting a position in continuation of the length of the pin or a position transverse to the pin to prevent withdrawal.

In a preferred embodiment there are two or more such motor brackets linked by a transverse connecting rod having means defining two or more recesses and a cover member normally biassed to obstruct access to each recess, the brackets possessing projections which fit in and are held within the recess. For example, a biassed slide cover can be pushed back to fit a spherical-lyended projection into the recess, and then released to hold the projection.

The invention will be further described with reference to the accompanying drawings which show the essentials of a single additional tiller arrangement including such a control gear.

Figure 10A:
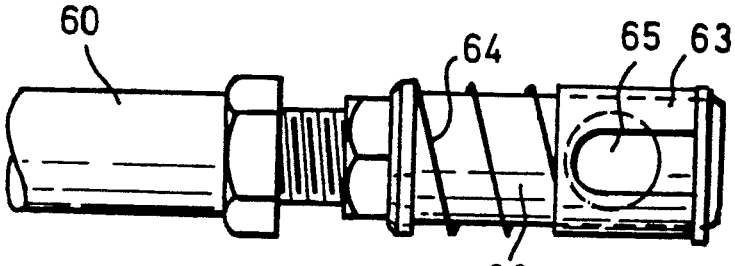
Figure 10B:
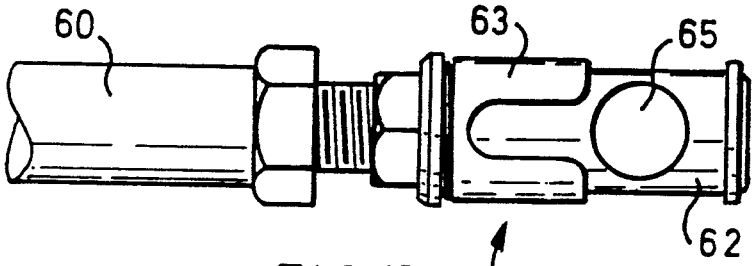
Figure 11:
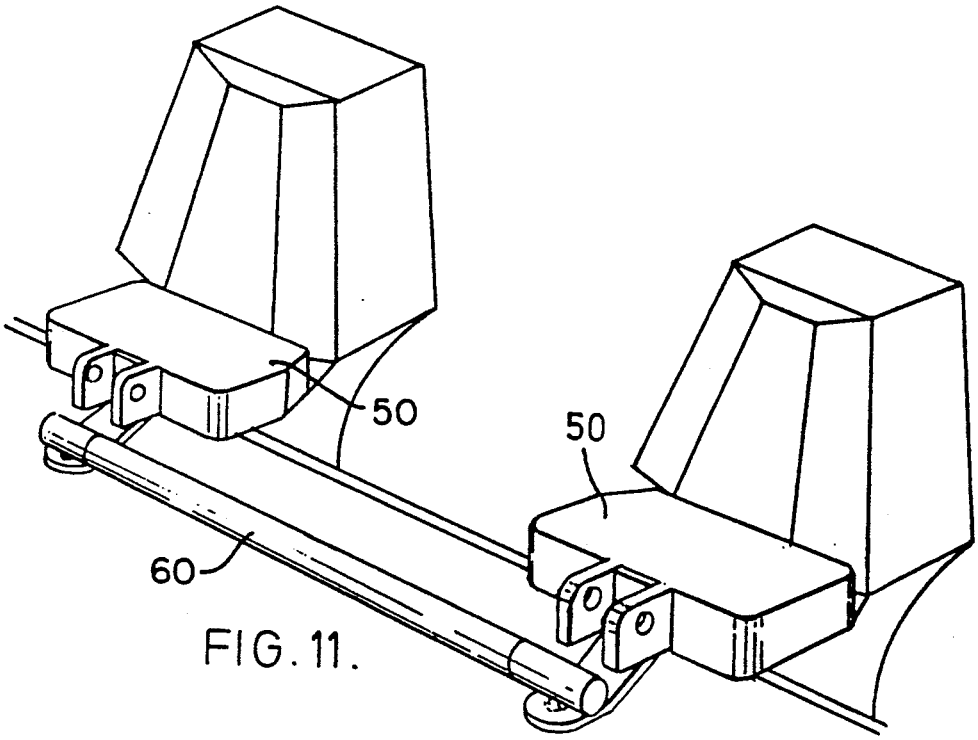

FIGS. 10*a* and 10*b* show, in two forms, one end of an interconnecting rod for placement between two such fixing brackets and FIG. 11 shows diagrammatically such fixing brackets with the interconnecting rod in place.

Figure 1:
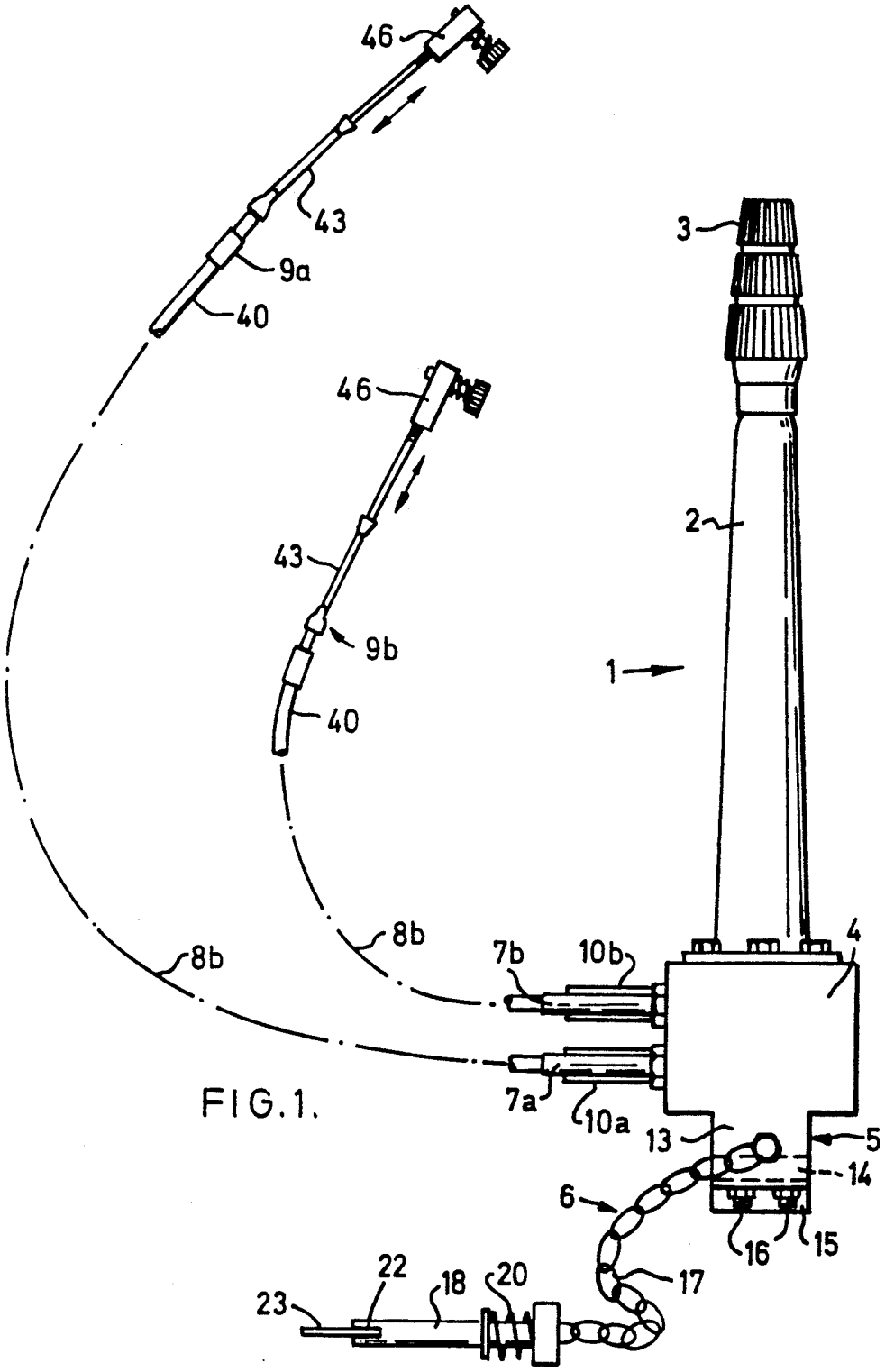
FIG. 1 shows a single heavy duty replacement tiller from the underside, with associated components.

FIG. 1 shows a heavy duty replacement tiller 1 comprising an arm 2 terminating in a conventional grip 3 which can twist in relation to the arm. At its inner end the tiller has a generally cubical base 4, configured at 5 for attachment to the steering arrangement of one a set of two (or more) outboard motors. Generally shown at 6 is a connecting pin for use in such interconnection.

From the side of the generally cubical base 4 there extends two cable surrounds 7*a* and 7*b*, and from these extend cables 8*a* and 8*b* respectively, terminating in throttle-connecting ends 9*a* and 9*b*. Aslo extending from the generally cubical base 4 are hollow cylindrical arms 10*a* and 10*b*.

Figure 2:
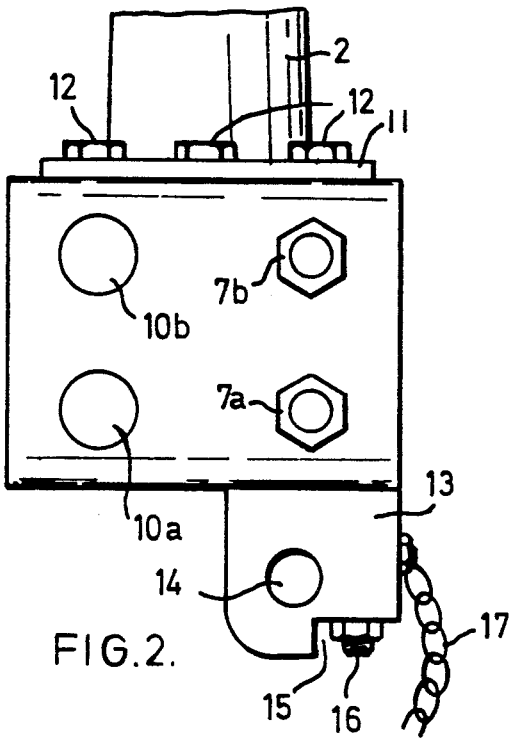
FIG. 2 shows a side view of the base of such a tiller.

FIG. 2 generally shows the base portion of the replacement tiller. The attachment of tiller arm 2 to the base portion 4 is shown as being constituted by permanently bolted base plate 11, with through bolts 12.

FIG. 2 also shows in more detail the attachment portion 5 of the tiller base. This is in the form of a metal block 13 with a through bore at 14 and a recess 15 in which are threaded two studs 16 for adjustment purposes, as discussed below. Block 5 also secures one end of chain 17, by which interconnecting pin 18 is attached to the block.

Figure 3:
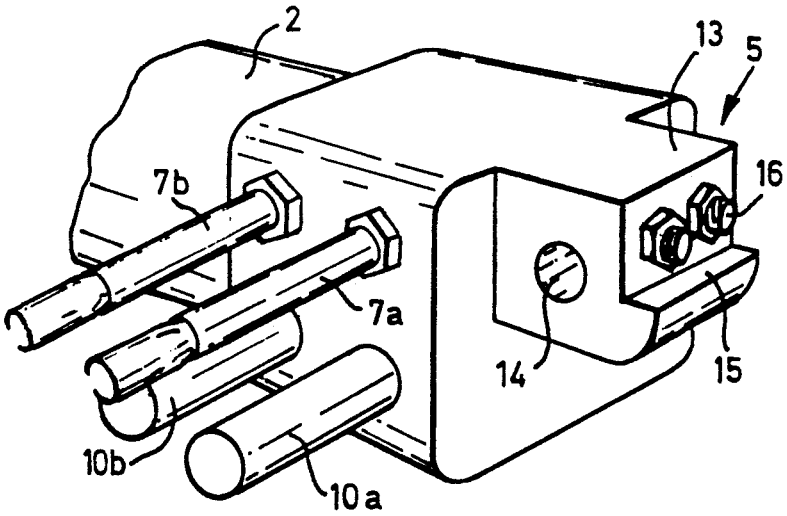
FIG. 3 shows a perspective view of the base of such a tiller.

FIG. 3 shows in perspective view the nature of the base portion of the tiller including the features indicated above and needs no further explanation.

Figure 4:
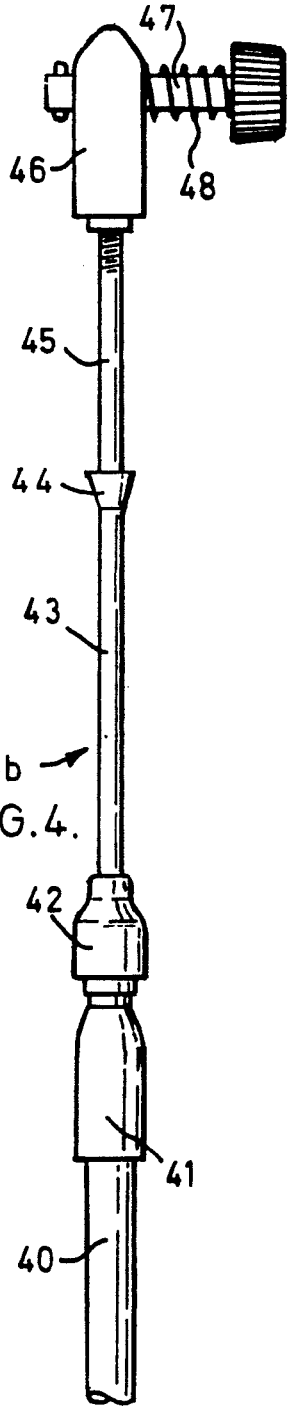
FIG. 4 shows the remote throttle connecting end of a cable attached to the tiller.

FIG. 4 shows structure at the remote ends of the cables. This terminal structure sequentially, comprises the housing 40, a bush 41, a diameter-change fitment 42, a sheath 43, a further fitment 44, and the end portion of the cable itself at 45. To this end portion is affixed a metal block 46, with a transverse shaft 47 passing therethrough and biased by spring 48 so that the end can be easily attached to a conventional throttle of an outboard motor.

Figure 5:
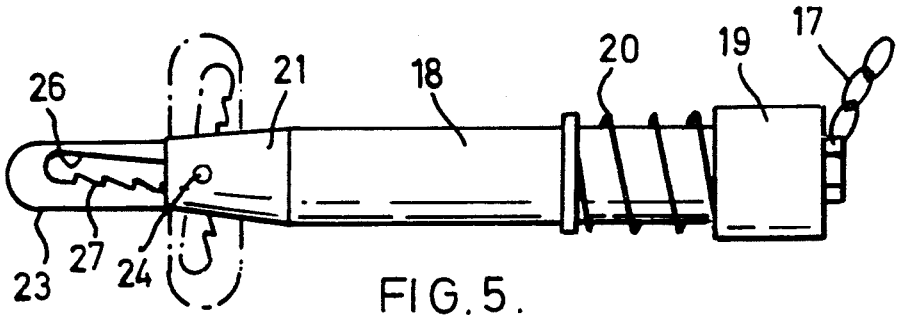
FIG. 5 shows a connecting pin by which the tiller of FIG. 1 is attached to a motor fixing bracket as described in relation to FIGS. 8 and 9 below.

The chain 17 and pin 18 are shown in more detail in FIG. 5. The pin has an enlarged end 19, which locates one end of a compression spring 20 extending some way down the shank of the pin. The remote end of the pin is tapered at 21 and has a central slot 22 (see FIG. 1), to accommodate a movable catch 23 which runs over transverse pin 24. Catch 23 has an internal somewhat tapering slot 26 with a saw tooth configuration 27 along one longitudinal edge.

The use of this pin will be described in more detail below.

Figure 6:
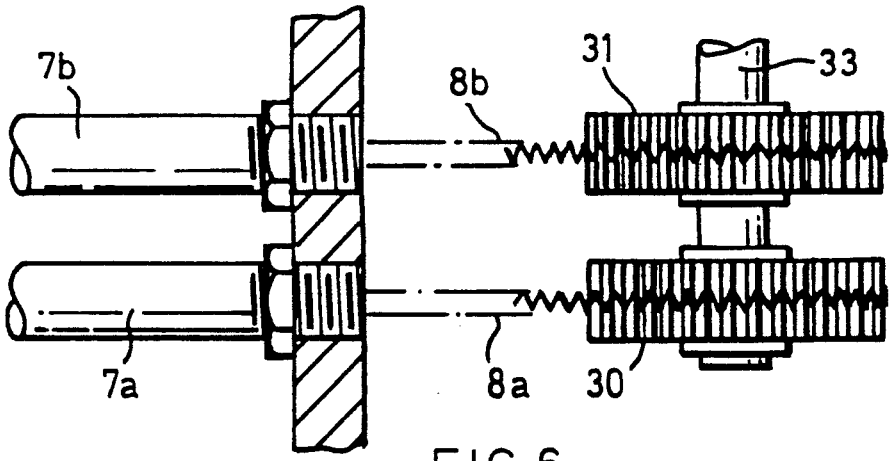
FIG. 6 shows diagrammatically the arrangement of the cable wind-up at the base of the tiller.
Figure 7:
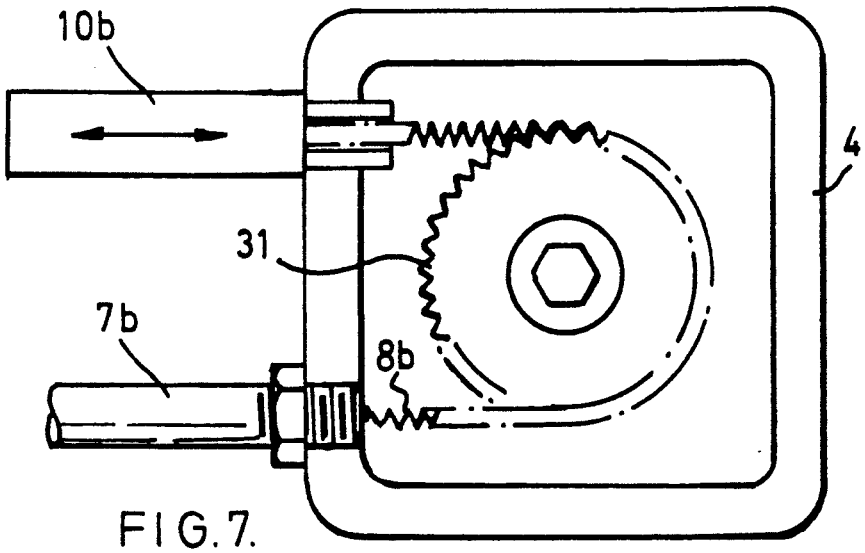
FIG. 7 shows the arrangement of FIG. 6 diagrammatically as viewed in a direction along the tiller.

FIG. 6 shows diagrammatically the nature of the connection inside of the base portion 4 of the replacable tiller. Cables 8*a* and 8*b* arrive within this base portion through the cyclindrical members 7*a* and 7*b* respectively, and pass around the respective toothed surfaces of pinions 30 and 31. Because the cables are formed as, or at least terminate in, a wound-wire covering, the teeth on the pinions 30 and 31 entrain the cables and pull them around their periphery. It is advantageous to introduce the end of the cable into the cylindrical extension member 10*a* or 10*b*, as shown in the end view of FIG. 7, to prevent crumpling and distortion of cable ends when the cable moves.

Because of the relatively stiff nature of the cable material the cables will advance or retract in an effective "push-pull" mode as the shaft 33, extending from the pinions to the twist grip 3, is rotated in one sense or the other.

The consequence of the rotation of shaft 33 in one sense or the other, is to either extend or retract both cables 8*a* and 8*b* simultaneously.

Thus, rotation of twist grip 3 in one sense or the other and consequent rotation of shaft 33 will ensure that throttles connected at the respective end configurations 46/47/48 of cables 8*a* and 8*b* will operate simultaneously and in the same sense.

Figure 9:
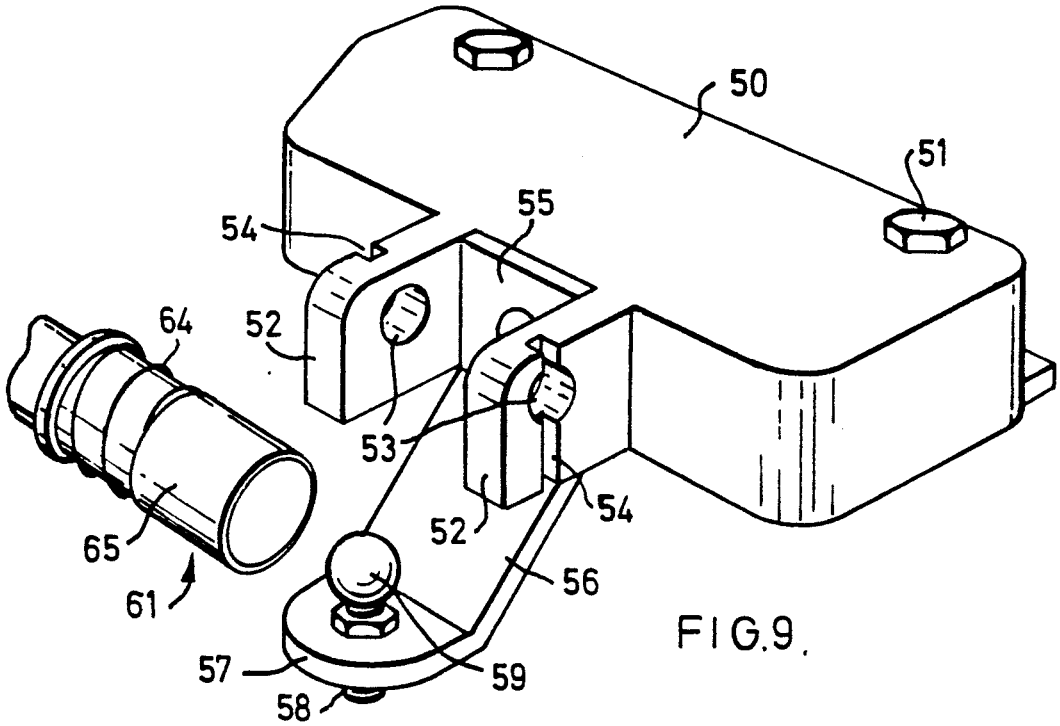
FIG. 9 shows the motor fixing bracket in perspective view ready to receive the tiller, and further indicates an interconnecting member as between two such brackets.
Figure 8:
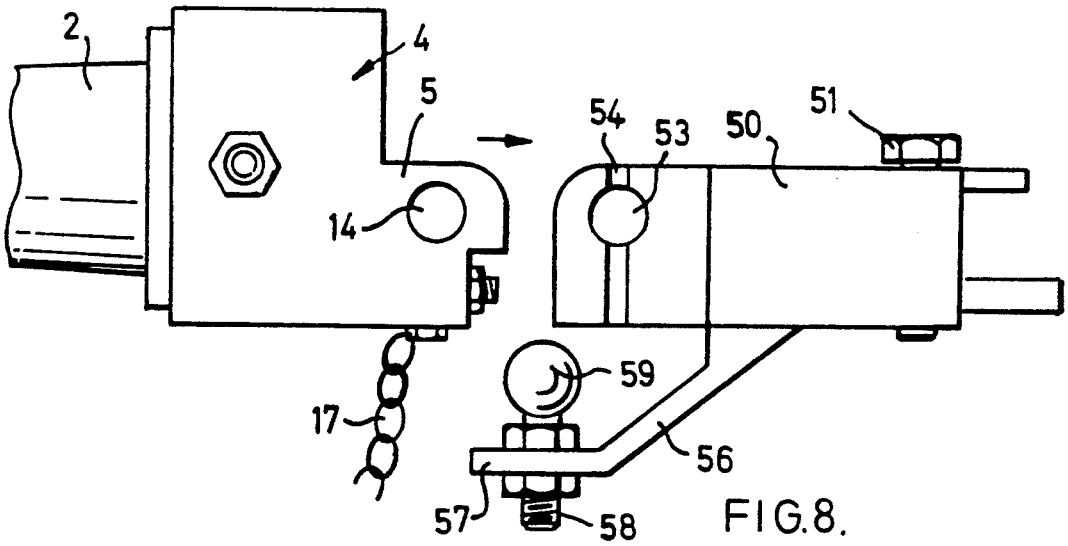
FIG. 8 shows the end of the tiller and its connection to a motor fixing bracket, seen from one side.

The replacement tiller as shown is configured to fit easily and quickly into a motor fixing bracket 50, as shown in FIGS. 8 and 9. Bracket 50 is in the form of a shell provided at 51 with an attachment suitable for connection to a conventional outboard motor mounting. Forwardly, the shell possesses two flat arms 52, possessing an aligned bore 53 and, on their outer faces, vertical slots 54 passing through the outer faces of the bores. A striker plate 55 is bolted into the base of the space defined between the parallel arm 52. Extending downward from the general region of the arms 52 is an inclined tab or connector 56 terminating in a horizontal end 57 upon which is mounted by shaft 58 an interconnecting knob 59, the purpose of which is discussed in more detail below.

As will be apparent from FIG. 8, the replacement tiller fits by its attachment block 5 between the two arms 52. At this time the aligned bracket bores 53 and the tiller bore 14 are coaxial. Pin 18 is thrust through the aligned bores until the clip 23 is free to move beyond the outer face of one of the arms 52. At this point the clip 23 is turned vertically by the operator and pushed downwards to engage by its serrated and tapering slot on pin 24. In this way the replacement tiller 1 is rapidly and securely assembled to the bracket 50.

The function of adjustment studs 15 will thus be readily apparent. Adjustment of these screws slightly alters the projection of the threaded studs within them. These bear upon the striker plate 55 for prior adjustment to give optimum stability in use.

The above description indicates how the tiller arm operates the throttle and how the tiller arm is attached to a mounting bracket. In practice, two such mounting brackets are interconnected so that the motors can turn about their respective steering axes simultaneously, each throttle being connected by respective cables 8*a* and 8*b* for simultaneous operation. FIGS. 10*a* and 10*b* show one end of an interconnecting rod 60, with a structure 61 adjustable in relation to the rod by threaded attachment 62. Structure 61 consists of a cylindrical member 62 and a sleeve 63 biased by a spring 64 so that normally it is forced outwardly to at least partly cover a through bore 65. The sleeve 63 can however be pushed back by finger pressure so as to make bore 65 available for use. There is structure of the above described nature at each end of the rod 60.

In use, the sleeves 63 are pushed back against the springs 64 so as to free the opening of bores 65, and each of the bores 65 are placed over the respective connection knobs 59 as shown in FIGS. 8 and 9.

The assembled interconnection is as shown in FIG. 11, it being understood that the total assembly will include the tiller attached to one or other of the brackets 50, and with the cables 8*a* or 8*b* respectively attached to the respective throttle controls of each motor.

I claim:

1. A tiller assembly for a joint throttle and steering control of two or more outboard motors each having a tiller arm, said assembly comprising:

(A) a single additional tiller arm possessing (a) a terminal twist grip at one end and an attachment base at the opposite end, (b) an internal longitudinal shaft rotatable about its axis and coupled to said twist grip, (c) pinion means coupled to said shaft, (d) two or more throttle cables attached individually to the respective motors and being entrained and gripped peripherally around said pinion means so that rotating said twist grip rotates said shaft and pinion means to provide simultaneous and equal movement to said throttle cables, and (e) a projection at the attachment base possessing a through transverse bore;

(B) a steering bracket for each motor, each bracket possessing (a) a projection for mechanical coupling to the other bracket and (b) parallel spaced arms with internally aligned through holes, the projection of the tiller arm being received between said spaced arms so that the bore and through holes are all aligned;

(C) a movable pin located in the aligned bore and through holes, thereby connecting the tiller arm to said one of the brackets; and (D) a transverse connecting rod having means defining two or more recesses within which recesses are located the respective projections of each steering bracket so that the brackets are mutually interconnected.

2. A tiller assembly as claimed in claim 1 wherein said pinion means comprises two pinions, and further including two cables controlling the throttles of two motors.

3. A tiller assembly as claimed in claim 1 in which each throttle cable terminates in a block having a transverse shaft passing therethrough, said shaft being biased by a spring for facilitating attachment of the throttle cable to the throttle.

4. A tiller assembly as claimed in claim 1 further comprising a projecting cable-end housing for each cable to accommodate movement of the cable end opposite the end coupled to the throttle.

5. The assembly as claimed in claim 1 wherein the pin has an end latch capable of movement between a first position in axial continuation of the length of the pin and a second position transverse to the pin to prevent pin withdrawal.

6. A tiller assembly as claimed in claim 1 further comprising a movable cover member for each connecting rod recess and a biasing means biasing each such member to cover its respective recess.

7. The assembly as claimed in claim 6 wherein the cover member is a transverse slide surrounding the rod and the biasing means comprises a spring coaxial with the rod, and each bracket projection is spherical at the end to fit into a respective recess and be held therein by the biased cover member.

* * * * *